US005119974A

United States Patent [19]

Mann

[11] Patent Number: 5,119,974

[45] Date of Patent: Jun. 9, 1992

[54] SPRAY BOTTLE WITH A FULL CIRCLE, COMPLEMENTARY OPERATIVE FEED SYSTEM CONNECTED TO A PUMP SPRAYER

[76] Inventor: Frederick J. Mann, 3032 Poplar Ct., Fairfield, Calif. 94533

[21] Appl. No.: 700,539

[22] Filed: May 14, 1991

Related U.S. Application Data

[63] Continuation of Ser. No. 421,120, Oct. 13, 1989, abandoned.

[51] Int. Cl.[5] ..... B67D 5/00

[52] U.S. Cl. ..... 222/376; 222/382; 222/383

[58] Field of Search ..... 222/321, 340, 341, 372, 222/376, 382, 383, 402.19

[56] References Cited

U.S. PATENT DOCUMENTS

| | | | |
|---|---|---|---|
| 2,765,963 | 10/1956 | Langguth | 222/255 |
| 3,545,488 | 12/1970 | Venus, Jr. | 222/376 X |
| 4,277,001 | 7/1981 | Nozawa | 222/321 |
| 4,371,098 | 2/1983 | Nozawa et al. | 222/321 |
| 4,572,406 | 2/1986 | Pratt et al. | 222/39 |
| 4,775,079 | 10/1988 | Grothoff | 222/321 |

FOREIGN PATENT DOCUMENTS

| | | | |
|---|---|---|---|
| 245734 | 10/1925 | United Kingdom | 222/402.19 |

*Primary Examiner*—Michael S. Huppert
*Assistant Examiner*—Anthoula Pomrening
*Attorney, Agent, or Firm*—Harold D. Messner

[57] ABSTRACT

The present invention relates to a spray bottle having full circle, continuous operational capability. It includes a mouth and a bottom wall, a reservoir of contained liquid, a human-powered pump sprayer attached to the mouth of the container, a straw extending into the contained liquid and a full circle, continuous complementary operative feed system in operational contact with the pump sprayer through the straw. The feed system of the present invention alternately connects the contained liquid to first and second entry ports in parallel relative to the straw as a function of working position. Assuming that the container is full or nearly full of liquid and that the spray bottle is in a normal upright working position, a first valve associated with the entry port near the bottom wall, is made to be operative open to liquid flow. Similarly, a second valve associated with the second entry port near the mouth of the container, is operated in a closed condition. By the results provided by the latter, air is prevented from entry into the straw to interrupt the liquid flow. Yet when the spray bottle is rotated in a half-circle, the valving conditions described above automatically reverse.

3 Claims, 4 Drawing Sheets

SPRAY BOTTLE WITH A FULL CIRCLE, COMPLEMENTARY OPERATIVE FEED SYSTEM CONNECTED TO A PUMP SPRAYER

This is a continuation of application Ser. No. 421,120 filed Oct. 13, 1989, now abandoned.

FIELD OF THE INVENTION

This invention relates to spray bottles for atomization of fluids by means of an attached pump sprayer and more particularly to a novel full circle, complementary operative feed system for for permitting multidirectional application of sprays of the contained liquids relative to differently oriented work surfaces.

DEFINITIONS

"Spray Bottle" is a system for atomizing contained liquids and includes a container having a narrow mouth, a reservoir of liquid, and a pump sprayer attached in fluid tight contact with the mouth of the bottle;

"Pump Sprayer" includes a movable piston that momentarily reduces pressure acting on a closure means in fluid contact with the contained liquid through a plastic straw. The partial vacuum both releases the closure means from its curved seat and permits atmospheric pressure within the container to drive the liquid up the straw through the valve seat and thence from a nozzle as an atomized spray. The pressure change is created by human-applied force to a movable piston, say through a trigger. The container is not pressurized by a secondary gas carrier, however;

"Nozzle" usually contains a spin element and nose bushing for varying the spray pattern from an exit port. The spray is variable from a fine mist to a course spray to a jet stream;

"Atomized spray" is a mixture of droplets of the contained liquid with air to facilitate their dispersal onto a working surface;

"Working surface" is usually two-dimensional such as the surface of a glass window, a tiled shower, a fender of an automobile, plant leaves etc.;

"Contained liquid" is any liquid that can be lawfully dispensed by human activated pump sprayers and included all conventional cleaning fluids and home/garden liquids including those that aid the growth of plants and to control insect, fungi growth and the like;

BACKGROUND OF THE INVENTION

Spray bottles of the prior art, have well known capabilities and characteristics. The dispensing of perfume and glass cleaning products are typical examples, using a human-powered pump strayer. Since pump sprayers are usually relative inexpensive, aerosol convenience is thus afforded the customer at a fraction of the cost.

A typical pump sprayer includes a movable piston. Movement of the piston momentarily reduces pressure on a closure means such as a valve ball. The ball is in fluid contact with contained liquid through a plastic straw. The partial vacuum that is created by the piston movement, both releases the ball from its seat and permits atmospheric pressure within the container to drive the liquid through the straw, over the seat and from a nozzle as an atomized spray. In a typical application, a pivotal trigger is used to drive the piston. An internal spring returns the trigger to its original position after each stroke.

Attachment of the pump sprayer to the glass or plastic container is by a spinable collar that engages threads on the exterior of the mouth of the container. The straw extends to its open end at the bottom of the container. A strainer also is attached at the open end of the straw.

Spray bottles that include the above-described pump sprayer are usually designed for operations in which the container is vertically positioned. In that position, the bottom of the container is closer to the earth's surface than the mouth. In such position, atmospheric pressure acts on the contained liquid in a downward direction relative to the earth's surface, toward the bottom of the bottle (called "a substantially normal upright working position"). These forces periodically act (when the trigger is released) to drive the liquid up the straw and thence from the container. As spray operations progress, the liquid in the bottle is reduced. And the resulting intersection of the liquid and surrounding air likewise falls to a final location at the bottom wall of the container. But if the spray bottle is tipped so that the end of the straw and strainer extends beyond the liquid, the coupling of the liquid within the straw and that within the reservoir of the bottle is severed. Thus the flow of liquid is interrupted. That is to say conventional spray bottles of which I am aware, do not have the capability of continuous, full circle operations where the bottle is tipped substantially from its conventional vertical upright working position. To be more specific, if the pump strayer and bottle can be tipped relative to a horizontal working plane parallel to the earth's surface through its centroid by an amount that places the end of the straw in the air (and not within the liquid), the spraying operation terminates. The amount of angle variation of course is a function of the amount of liquid within the container and orientation of the straw. If the container is nearly full and the straw stretches the full length of the container, then the permitted angular variation is somewhat large. But as the liquid is used up, such critical angle dramatically decreases. But irrespective of liquid amount, no spray bottle of which I am aware can continuously operate in a full circle, say about its centroid, as I propose to permit multidirectional spraying of differently oriented work surfaces. Further, where the circle of operation is defined by a critical angle of 180 degrees (i.e., the container is upside down), none are operational since the entry port of the straw, more likely than not, terminates in air and not in the continued liquid. In such position, the mouth of the container is closer to the earth's surface than the bottom wall by a maximum vertical amount (called "a maximum upside down working position"). In such position, the atmospheric pressure acts downwardly toward the mouth of the container.

SUMMARY OF THE INVENTION

The present invention relates to a spray bottle having full circle, continuous operational capability. It includes a mouth and a bottom wall, a reservoir of contained liquid, a human-powered pump sprayer attached to the mouth of the container, a straw extending into the contained liquid and a full circle, continuous complementary operative feed system in operational contact with the pump sprayer through the straw. The feed system of the present invention alternately connects the contained liquid to first and second entry ports in parallel relative to the straw as a function of working position. The first and second entry ports are positioned near the bottom wall and the mouth of the container, respectively. Each is fitted with valving means that operate in complementary fashion, i.e., when one valve opens, the other closes and vice versa. Assuming that the container is full or nearly full of liquid and that the spray bottle is in a normal upright working position, thus the first valving means associated with the entry port near the bottom wall, would be open to liquid flow. Similarly, the second valving means associated with the second entry port near the mouth of the container, would be closed. By the latter, air is prevented from entry into the straw to interrupt the liquid flow.

Yet when the spray bottle is rotated in a half-circle, the valving conditions described above automatically reverse.

DESCRIPTION OF A PREFERRED EMBODIMENT

Figure 1:
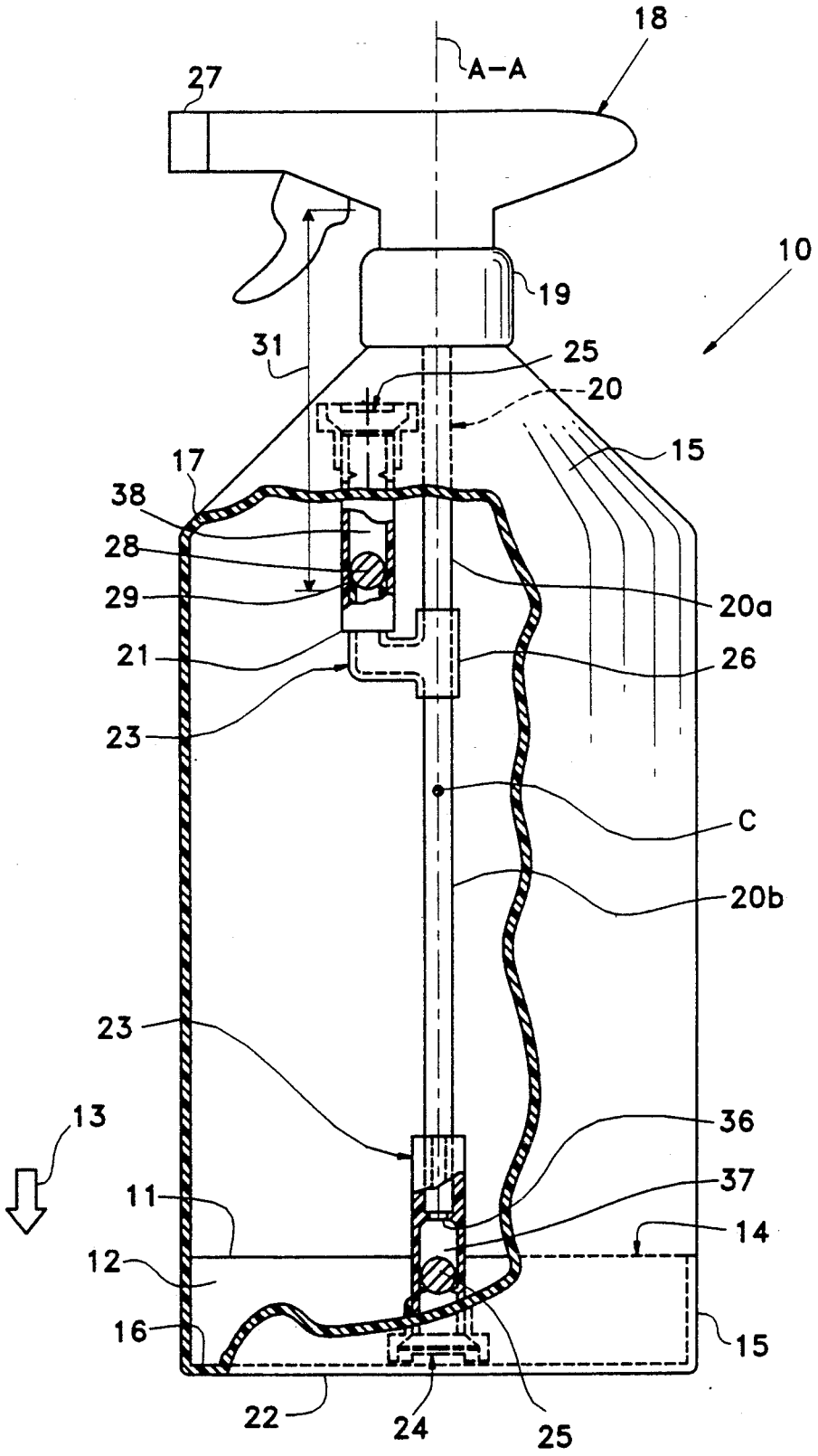
FIG. 1 is a side elevation of a spray bottle of the present invention, partially cut-away to illustrate the full circle complementary operative feed system of the present invention operating in a normal vertically upright working position.

FIG. 1 illustrates a spray bottle 10 operating a normal vertically upright working position. Such working position is characterized by atmospheric pressure acting at liquid surface 11 of contained liquid 12 be in the direction of arrow 13. The liquid 12 is housed within and forms a reservoir 14 for container 15. The arrow 13 is in the direction of bottom wall 16 away from mouth 17. A pump sprayer 18 threadably attaches to the mouth 17 through a collar 19. Fluid coupling between the reservoir 14 and the pump sprayer 18 is via segmented straw 20, divided into upright segments **20*a* and 20*b* by first valve assembly 21 of complementary operating feed system 23 of the present invention. Second valve assembly 22 of the feed system 23 attaches to the far end of straw segment 20*b*. The operations of the first and second valve assemblies 21, 22 will be explained below in more detail. Suffice it to say, that in FIG. 1, the valve assembly 21 is closed to fluid flow thereby preventing air from entering the straw segments 20*a*, 20*b* to decouple the liquid column, while valve assembly 22 is open to liquid flow. Such flow is in the reverse of arrow 13, from reservoir 14 upward through the straw segments 20*a*, 20*b*. The reverse of such flow conditions occurs with the spray bottle 10 in the upside down working position of FIG. 2**.

Now in more detail, note that vertical plane through the axis of symmetry A—A of the container 15, bisects the latter. The bottom wall 16 is thus closer to the earth-'surface (not shown) than the mouth 17 of the container 15.

As a partial vacuum is created within the pump sprayer 18 as explained below, the contained liquid 12 is driven via entry port 24 near the bottom wall 16, through second valve assembly 22 and segmented straw **20*b*, thence past a footed Tee 26 of the first valve assembly 21, to the nozzle 27 of the pump sprayer 18**.

As the liquid is being driven from the container 15, ball 28 of the first valve assembly 21 is seen in FIG. 1 to be resting on valve seat 29. In this regard, the weight of the ball 28 must be greater than that of the distributed weight of that portion of the contained liquid 12 within the segment straw **20*a* over the projection 31**.

Figure 2:
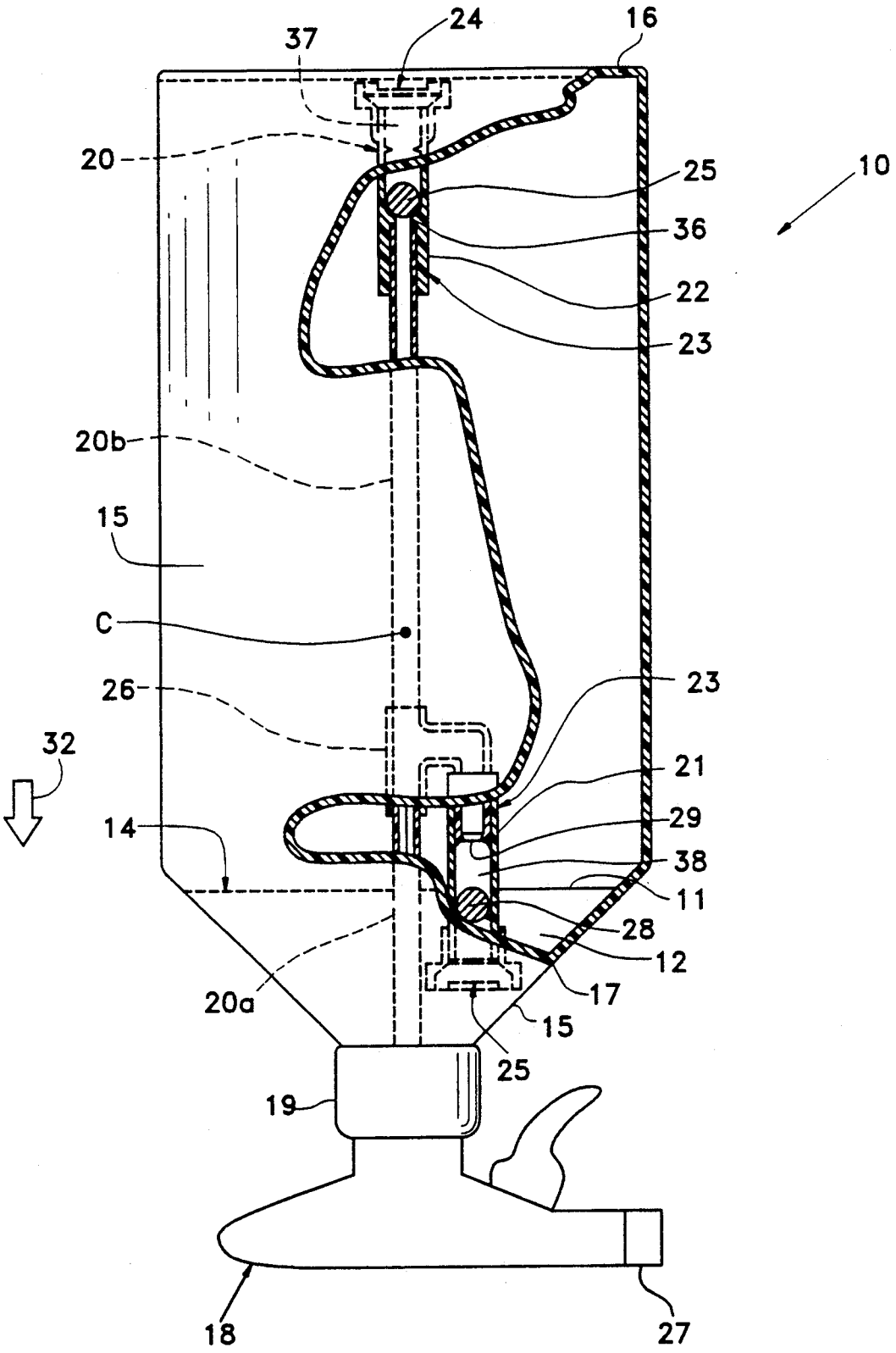
FIG. 2 is a side elevation of a spray bottle of the present invention, partially cut-away to illustrate the full circle complementary feed system of FIG. 1 operating in a complementary upside down working position.

FIG. 2 illustrates the spray bottle 10 inverted from the working position of FIG. 1 to operate in an upside down position. As shown, such position requires that air pressure within the container 15 act at the liquid surface 11 of the contained liquid 12 in the direction of arrow 32. The arrow 32 extends toward the mouth 17 of the container 15 away from the bottom wall 16.

Fluid coupling between the reservoir 14 and the pump sprayer 18 is via entry port 25 located near the mouth 17. The resulting liquid column then extends to the interior of the first valve assembly 21, thence through segmented straw **20*a* and finally to the nozzle 27. On the other hand, the ball 25 of the second valve assembly 22 is seated relative to seat 36 thus closing the entry port 24 (positioned near the bottom wall 16) to fluid flow. Such closure prevents entry of air via the entry port 24 into segmented straw 20*b*** and decoupling of the liquid column therein.

As the partial vacuum is again created within the sprayer 18, the contained liquid 12 is driven via entry port 25 around ball 28, through footed Tee 26 and thence from segmented straw **20*a* to the nozzle 27. On the other hand, since the ball 25 of the second valve assembly 22, rests on seat 36, the complemetary entry port 245 is closed to fluid flow. Hence air is prevented from entering into the segmented straw 20*b* above the surface 11 of the contained liquid 12**.

By comparing the operations of the first and second valve assemblies 21, 22 in FIGS. 1 and 2, several principles of performance become evident. For example, the container 15 of FIGS. 1 and 2 can be manipulated about a plurality of axes and yet still provide full circle, continuous spraying operations for the operator. That is to say, for example, the container 15 can be rotated about a series of axes say relative to a horizontal working plane that passes through centroid C, all without there being an interruption of the flow of liquid 12 to the sprayer nozzle 27. In the various positions, the balls 25, 28 of the first and second valve assemblies 21, 22, respectively, complementarily act to prevent entry of air into the straw 20 via one of the ports 24, 25, yet allow the liquid 12 to enter via the other of the ports 24, 25 and then to be driven to the nozzle 27 and expelled via the complementary valve assembly. Movement of the balls 25, 28 is relative to the seats 36, 29 respectively. The degree of such movement is based on the magnitude of force due to gravity acting normal to the seats 36, 29. If such component is larger than the friction forces acting on the balls within the races 37, 38, respectively, then movement occurs.

Figure 3:
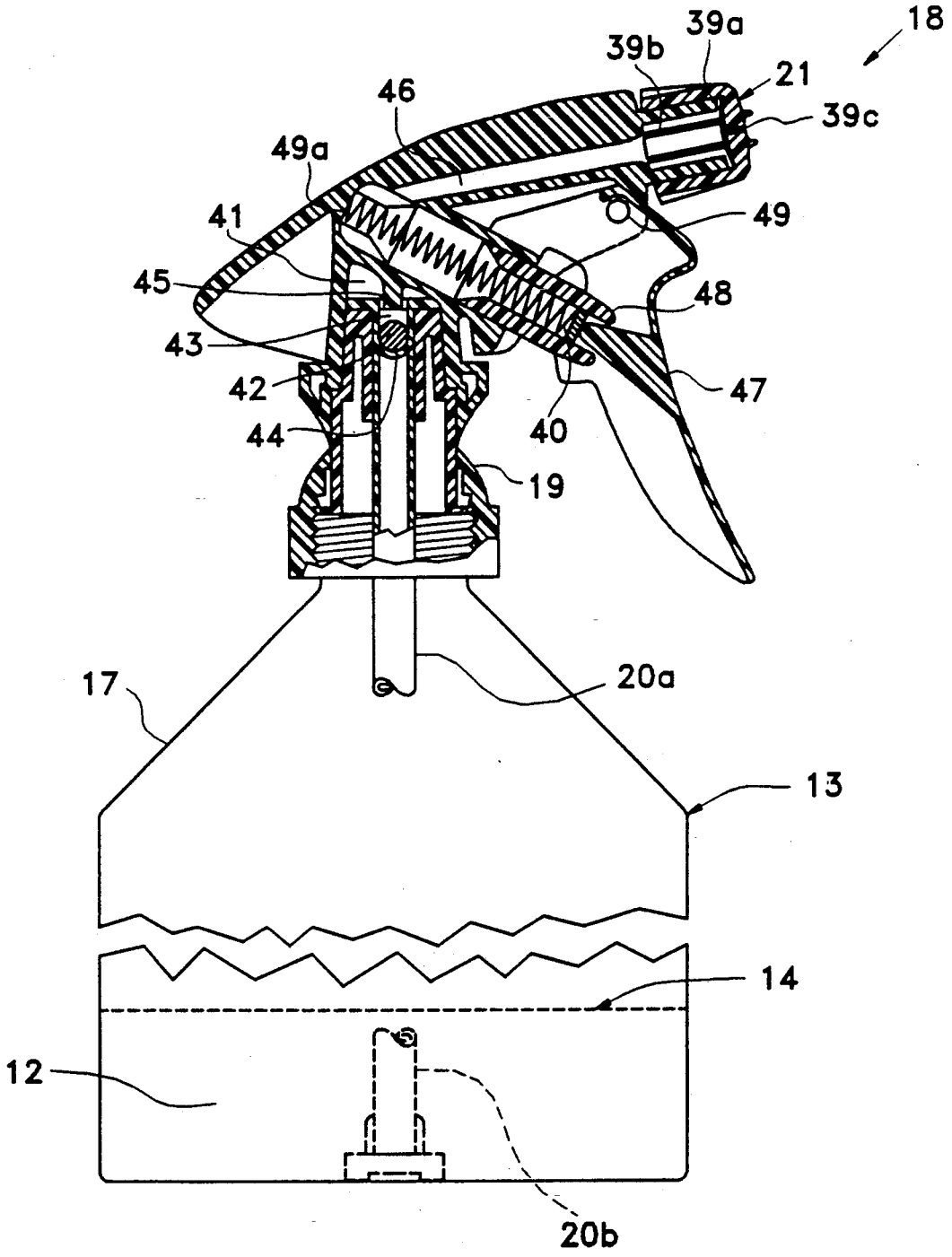
FIG. 3 is a cross section of the spray pump of the spray bottle of FIGS. 1 and 2.

FIG. 3 illustrates the pump sprayer 18 in more detail.

As shown, the pump sprayer 18 includes a movable piston 40. Its movement momentarily produces a partial vacuum in cupola-like passageway 41 adjacent to ball 42. The ball 42 can thus oscillate along race 43 between valve seat 44 and stop 45. This movement alternately closes and re-opens the upper straw segment **20*a* to the partial vacuum within the cupola passageway 41. As a result, the contained liquid 12 that forms the reservoir 14 is caused to flow up through the straw segments 20***b*, 20*a* to the cupola passageway 41, thence to linear passageway 46 to nozzle 27.

To and fro movement of the piston 40 is achieved by trigger 47. Force is applied to the trigger by an operator (not shown). The trigger 47 also has a mid-segment 48 notched to receive the piston 40. A pivot 49 allows angular movement of the trigger 47. Such movement is converted to rectilinear motion of the piston 40 because of the flexible connection between these elements. An internal spring 49*a* returns the piston 40 (and the trigger 47) to original stroke start positions. Attachment of the pump sprayer 18 to the container 15 is via spinable collar 19. The collar 19 is rotatable to connect to the exterior of the mouth 17 of the container 15. Nozzle 27 includes a threadable nose bushing 39*a* that squeezes spinner element 39*b* in order to change the spray pattern of the liquid at exit port 39*c*.

Figure 4:
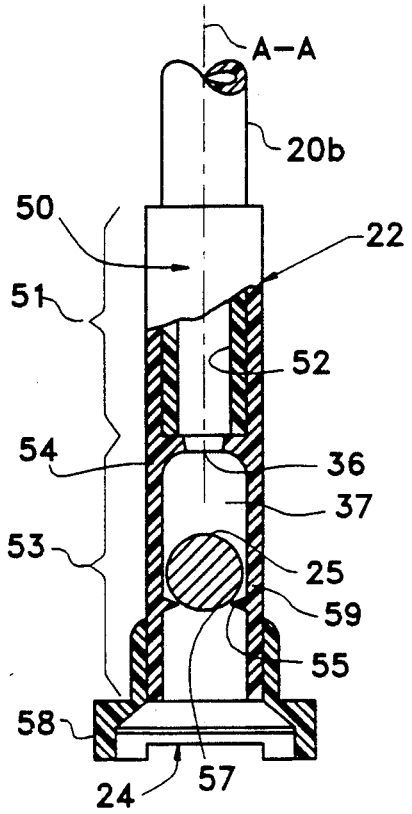
FIG. 4 is a partial cut-away view of a first valve assembly of the complementary feed system of FIGS. 1 and 2.

FIG. 4 illustrates first ball valve assembly 22 of FIG. 1 in more detail.

As shown, the first ball assembly 22 is attached to the open end of straw segment 20*a* adjacent to which is the valve seat 36. The valve seat 36 receives the ball 25 in the manner previously mentioned, i.e., when the working position of the valve assembly 21 is reversed by 180 degrees and the spray bottle is in the position of FIG. 2. The assembly 22 includes a cylindrical extension 50 having an axis of symmetry coincident with axis A—A of the container 15. The extension 50 is divided into a first segment 51 and a second segment 53. The first segment 51 is in surface contact with wall 52 of the straw segment 20*b*. The valve seat 36 marks the dividing plane of the first and second segments 51 and 53. The second segment 53 includes a bulbous wall segment 54 from which the valve seat 36 is formed. The interior of the second segment 53 also houses the ball 25 and the race 37 in the manner previously mentioned. Such constructional features of the second segment 53 permits the ball 56 to travel between the seat 36 and star-shaped stop 55 in a coordinate manner as described hereinafter. That is to say, the diameter of the segment 53 combines with the location of stop 55 to permit liquid flow via entry port 24 thence through passageway 57 around ball 25 and thence to straw segment 20*b*. Strainer 58 completes the assembly.

Note that the associated wall 59 of the second segment 53 is thickest at bulbous segment 54 where the valve seat 36 is formed. Thus when the container is tipped from its normal upright working position (FIG. 1) toward an upside down working position of FIG. 2, the capture of the ball 25 at the seat 36 can occur after the axis of symmetry A—A of the container passes beyond a horizontal plane say through centroid C of FIGS. 1 and 2, by a selected amount. Such amount is related to the magnitude of the force with which the ball 25 is pulled toward the earth's surface and the amount of frictional forces between the ball 25 and the associated wall 59 of the segment 53, that must be overcome.

Figure 5:
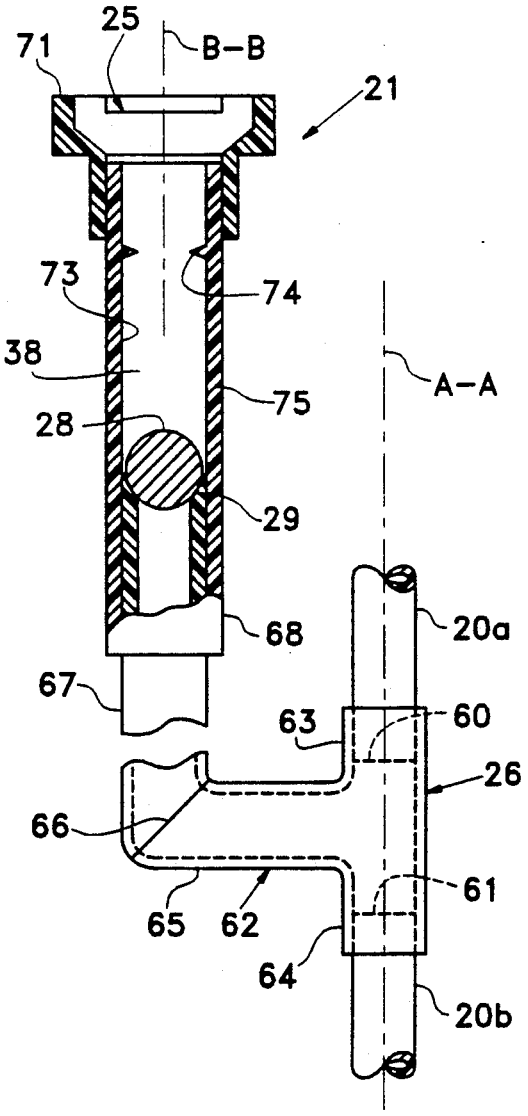
FIG. 5 is a partial cut-away view of a second valve assembly of the complementary feed system of FIGS. 1 and 2.

FIG. 5 illustrates second ball valve assembly 21 of FIG. 1 in more detail.

As shown, the second ball valve assembly 21 is shaped like the Arabic number "4" and is attached to first and second severed ends 60, 61 of the straw segments 20*a*, 20*b* respectively. Such attachment is via footed Tee 26 and is located near the centroid of the container. The Tee 26 has parallel legs 63, 64 to achieve such attachment. Remaining third leg 65 is normal to legs 63, 64 but is bent at 66 to form upright leg 67. The upright leg 67 extends within and is collinear of a parallel leg 68 and has an end that been re-worked to form the valve seat 29 previously described. At the end opposite to the seat 29, the leg 68 terminates in a strainer 71 and in the entry port 25 previously mentioned. Note that inner surface 73 is smoothly constructed whereby the resulting race 38 of FIGS. 1 and 2, does not unduly restrain movement of the ball 28. In operation, the valve ball 28 is caused to oscillate between star-shaped stop 74 and the valve seat 29 to either close or open entry port 25 to fluid flow. In the normal upright working position of the spray bottle of FIG. 1, the ball 28 is placed in closure contact with the valve seat 29. The entry port 25 is thus closed to fluid flow. In that way the liquid column that exists within the straw segment 20*a*, 20*b* is not severed. Further, the component of force normal to the seat 29 associated with the ball 28 (due to gravity) must exceed the distributed weight of the liquid contained in the straw segment 20*a* over the projection 31 of FIG. 1 as previously mentioned. Otherwise the ball 28 may release from the valve seat 29.

When the container of the invention is in the upside down working position of FIG. 2, the ball 28 is released from the seat 29 to open the entry port 25 to fluid flow. Strainer 74 completes the assembly.

METHOD ASPECTS

The present invention has special application in operating a spray bottle relative to a series of positions at least two of which are above and below a horizontal working plane say one through the centroid of the spray bottle. Simultaneously, the spray pump is operated in a continuous fashion.

In the manner previously described, the steps can include the following:

(i) establishing a working position for the container relative to the horizontal working plane akin to one of a normal upright working position and a complementary upside down working position wherein a first entry port is closed to air and a second entry port is open to liquid flow;

(ii) generating a partial vacuum within the pump means;

(iii) periodically driving the liquid within the container over a series of work positions in which the pump through said second entry port via an open first valving means while bypassing a closed second valving means relative to the first entry port whereby a spray is generated at the nozzle of the pump spray irrespective of work position of the spray bottle, (iv) reestablishing a new working position relative the horizontal working plane akin to the other of the normal and upside down working positions, and (v) repeating steps (ii) and (iii).

Further method features of the present invention deserve additional discussion. Such features have to do with the fact that conventional spray bottles can be reworked and the complementary feed system as described above added, to achieve all features and advantages of the present invention. In this regard assume each such conventional spray bottle comprises a container having a mouth and bottom wall, a straw that is extendable substantially the full length of the container, and a human-powered pump sprayer attachable to the mouth and straw. In accordance with invention, the bottle can be reworked to provide full circle operations, by the following steps:

(i) severing the straw along a plane substantially normal to its axis of symmetry to form segmented straw means, (ii) attaching a complementary full circle complementary operative feed system to said severed straw means to provide complementary related flow operations for parallel first and second entry ports near the bottom wall and mouth of the container, and (iii) attaching the pump sprayer to the mouth of the container whereby suction therebetween momentarily causes flow of the contained liquid within the container through the feed system and thence to the nozzle of the pump sprayer as a function of the working position of the container even though the working position may be a series of positions that define a full circle.

Having described a method and apparatus in accordance with the invention in which advantages can be appreciated by those skilled in the art, it also is evident that certain variation are suggested. For example, the gravity driven valve assemblies 21, 22 could be replaced by other powered valving means in which its controller is made to operate based upon container orientation. It is therefore my intent that such variations be within the scope of the invention as set forth in the following claims.

What is claimed is:

1. In the reworking of conventional spray bottles each comprising a container containing liquid having a mouth and bottom wall, a straw extendable substantially the full length of the container, a nozzle, and a human-powered pump sprayer attachable to the mouth, nozzle and straw and including an angularly pivoting trigger and, a rectilinearly moving piston, said trigger being connected to said piston wherein angular movement of said trigger is converted to rectilinear movement of said piston to expel said contained liquid from said nozzle in surprisingly large volumes, the improvement for providing full circle operations, comprising the steps of:

(i) severing the straw along a plane substantially normal to its axis of symmetry to form segmented straw means, (ii) attaching a full circle complementary operative feed system to said severed straw means wherein first gravity initiates valving means of complementary operative first and second valving means is positioned adjacent to said bottom wall of the container upstream of a first entry port and wherein second valving means is positioned adjacent to said mouth of said container upstream of a second entry port and defining complementary conditions relative to said entry ports whereby enhanced flow of said contained liquid from said nozzle is achieved in at least a complementary upside down position for said container wherein captured liquid within said straw between said first valving means and said pump sprayer adds to total flow from said nozzle, and (iii) attaching the pump sprayer to the full circle complementary operative feed system and attached severed straw means and to the mouth of the container whereby suction therebetween momentarily causes enhanced flow of the contained liquid within the container through the feed system and thence to the nozzle of the pump sprayer as a function of the working position of the container even though the working position may be a series of positions that define a full circle especially when said container is in a complementary upside down position wherein captured liquid within said straw between said first valving means and said pump sprayer adds to total flow from said nozzle.

2. The improvement of claim 1 in which step (ii) is further characterized by the first entry port being open to liquid flow and said second entry port being closed to both liquid and air flow to thereby define a normal upright working position for the container.

3. The improvement of claim 1 in which step (ii) is further characterized by the first entry port being closed to liquid and air flow and said second entry port being open to liquid flow to thereby define a complementary upside down working position for the container.

* * * * *